United States Patent [19]

Jeremic

[11] Patent Number: 4,766,786

[45] Date of Patent: Aug. 30, 1988

[54] ADJUSTABLE WRENCH

[76] Inventor: Miodrag Jeremic, 241 W. King Edward Street, Vancouver, British Columbia, Canada, V5Y 2J1

[21] Appl. No.: 3,084

[22] Filed: Jan. 14, 1987

[51] Int. Cl.[4] ..... B25B 13/12

[52] U.S. Cl. ..... 81/129; 81/155; 81/165; 81/166

[58] Field of Search ..... 81/166, 168, 155, 126, 81/129.5, 157, 158, 175

[56] References Cited

U.S. PATENT DOCUMENTS 4,520,699 6/1985 Jeremic ..... 81/166

FOREIGN PATENT DOCUMENTS 792916 1/1936 France ..... 81/166

*Primary Examiner*—Frederick R. Schmidt

*Assistant Examiner*—Maurina Rachuba

*Attorney, Agent, or Firm*—Spensley Horn Jubas & Lubitz

[57] ABSTRACT

The present invention provides a wrench having a removable key and key adjustment assembly. The key itself includes a nut receiving face having chamfered upper and lower edge regions to one side of the key and a notch intermediate the other side of the key. The key is removably secured to a threaded stem fitted within a longitudinal opening through the wrench head with a screw securing the stem to the key. The screw releases the stem and the key from another with the stem being then removable through the axial opening and the key itself being removable from the wrench head by engaging the notch with the edge of the cavity and clearing the chamfered edges past the cavity wall suh that the key pulls directly out through the cavity.

2 Claims, 2 Drawing Sheets

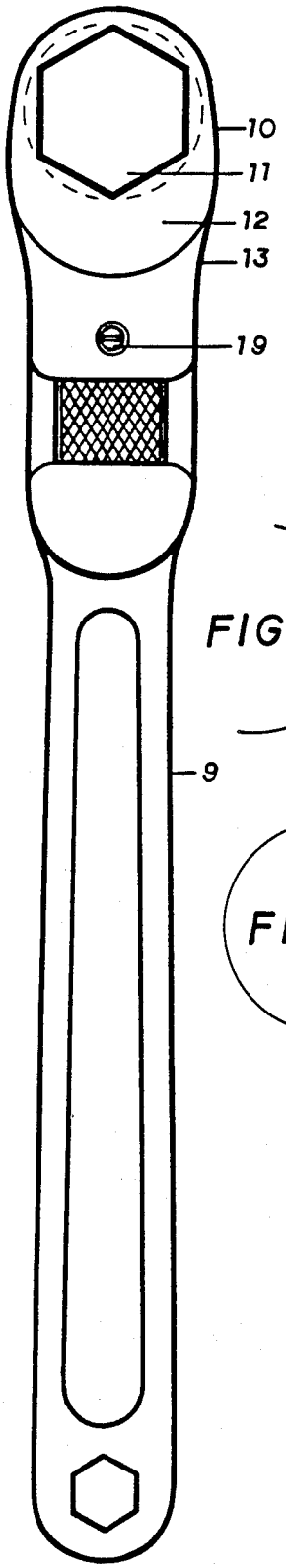
FIG•1•
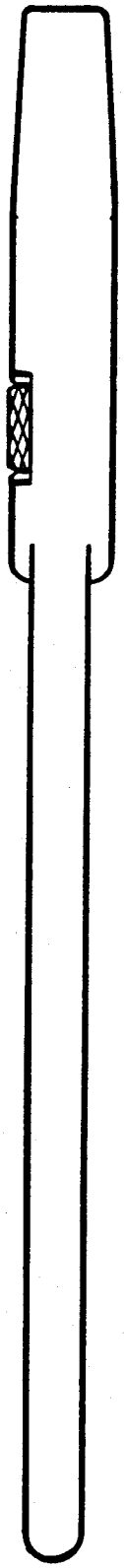
FIG•3•
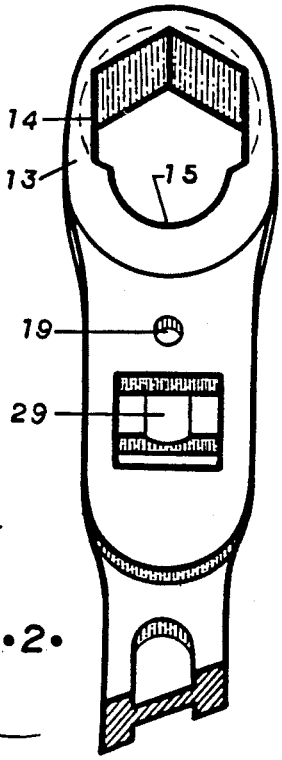
FIG•2•
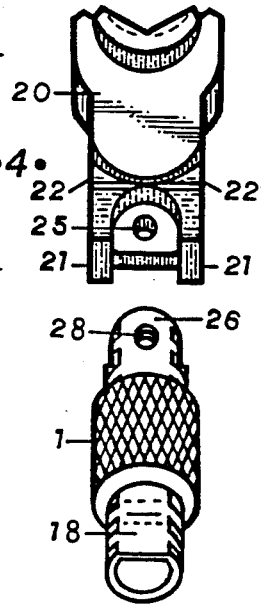
FIG•4•

ADJUSTABLE WRENCH

FIELD OF THE INVENTION

The present invention provides an adjustable wrench having a key and key adjustment assembly both of which are completely removable from the wrench head.

DESCRIPTION OF THE PRIOR ART

Adjustable wrenches are well known. They generally comprise a handle and a fixed jaw mounted on or integral with the handle. A movable jaw or key is mounted on the threaded shaft by a joint that allows the shaft to rotate relative to the key. The shaft is mounted within a nut, typically knurled, so that rotation of the nut advances or retards the shaft and thus the key. Thus the position of the key relative to the fixed jaw is varied to adjust the size of nut or bolt head that the wrench can grip.

In many adjustable wrenches the key and the threaded stem for adjusting the position of the key are permanently trapped within the wrench. Thus if the stem is damaged the key can no longer be adjusted and the entire wrench must be replaced.

In my U.S. Pat. No. 4,520,699 issued June 4, 1985 and entitled "Adjustable Wrench", I have provided a threaded stem and key assembly in which the threaded stem is removable from the wrench. However, in the patent, the key remains trapped within the wrench. This can present difficulties if the nut receiving face on the key becomes damaged as it can make the wrench inoperative.

U.S. Pat. No. 2,376,764, issued May 22, 1945 to Flower, describes an adjustable box wrench, where it would appear possible to remove the lower adjustable face from the wrench. However, the threaded adjustment member used for adjusting the position of the face remains permanently within the wrench, giving problems as described above in the event that the threads for the adjustment become damaged. U.S. Pat. No. 2,912,891, issued Nov. 17, 1959 to Neff, shows a different type of adjustable box wrench, in which the entire head of the wrench, including the integral threaded stem is removable from the wrench. As anyone who has worked with this type of box wrench will appreciate, the head of the wrench can wobble at maximum extension and, in fact, may inadvertently be pulled out of the wrench head.

SUMMARY OF THE INVENTION

The present invention provides a wrench, having a wrench head with a variable nut receiving cavity, and a removable key and key adjustment assembly at the nut receiving cavity. The key includes upper and lower chamfered or bevelled edge regions to one side of the key with a notch intermediate the other side of the key. The key adjustment assembly comprises a threaded stem fixed against rotation in an opening in the wrench head and removably secured by securing means to the key. Further provided in the adjustment assembly is a finger adjustment member threaded to and adjusting the stem to move the key and vary the size of the nut receiving cavity. Also provided in the wrench head is an access to the securing means to release the stem and key from one another. The stem is removable through the opening while the key is removed directly through the nut receiving cavity by engaging a notch on the cavity wall with chamfered edge regions on the opposite side of the key, then clearing past the edge of the cavity to pull the key directly out through the cavity.

With the wrench of the present invention—where the key is removable from the cavity and the threaded stem is removable separately from the key—each component can be replaced independently of one another, rather than having to replace the entire working mechanism or even the entire wrench in the event of damage to the adjustment assembly or the key.

DRAWINGS

The above, as well as other advantages and features of the present invention will be described in greater detail, according to the preferred embodiments of the present invention in which:

FIG. 1 is a front perspective view of a wrench, according to a preferred embodiment of the present invention;

FIG. 2 is an exploded rear perspective view of the wrench head of FIG. 1;

FIG. 3 is a partially exploded side plan view of the wrench head of FIG. 1;

FIG. 4 is a bottom perspective view of the key from the wrench assembly of FIG. 1;

DESCRIPTION OF THE PREFERRED EMBODIMENTS

The drawings show a wrench, generally indicated as 9 and having a wrench head 10. The wrench head 10 is provided with a cavity 11 for receiving nuts, bolt heads and the like. The wrench head 10 has forward side 12 and a rearward side 13, the upper and lower edges of which are indicated at 14 and 15 respectively in FIG. 2.

Figure 5:
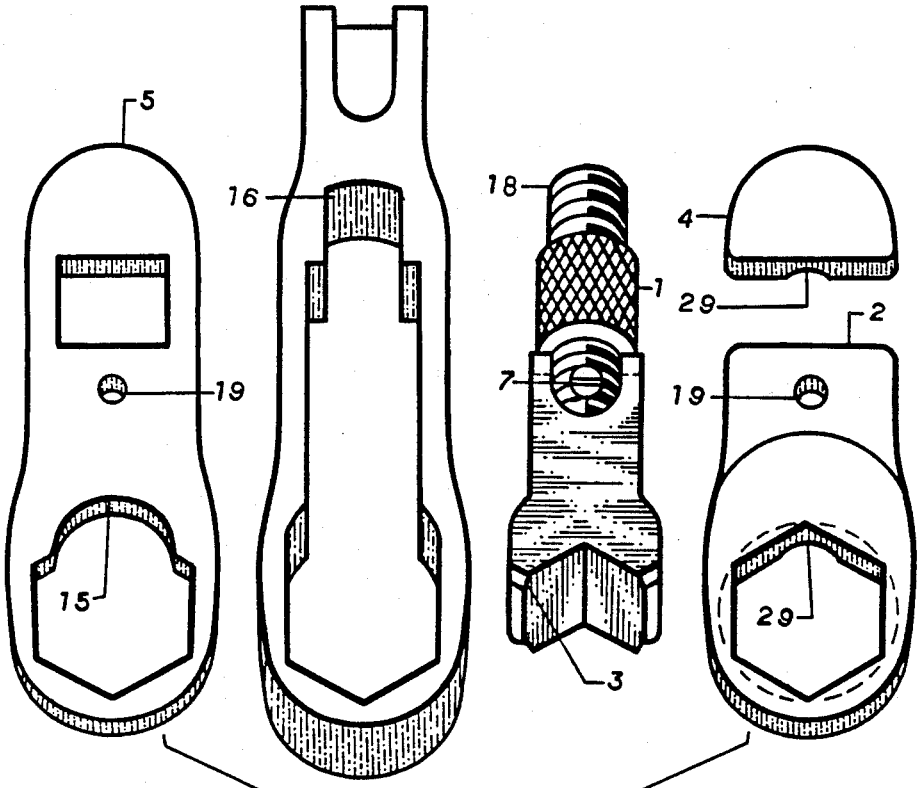
FIG. 5 is an exploded front perspective view of the wrench head of FIG. 1.
Figure 6:
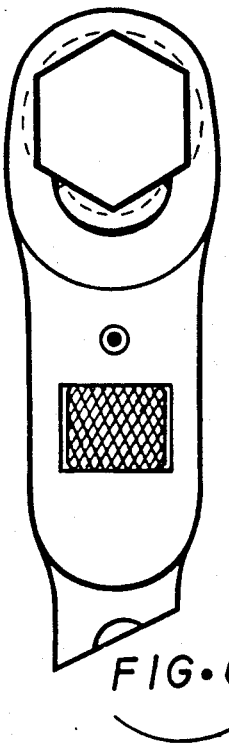
FIG. 6 is a detail of the wrench.
Figure 7:
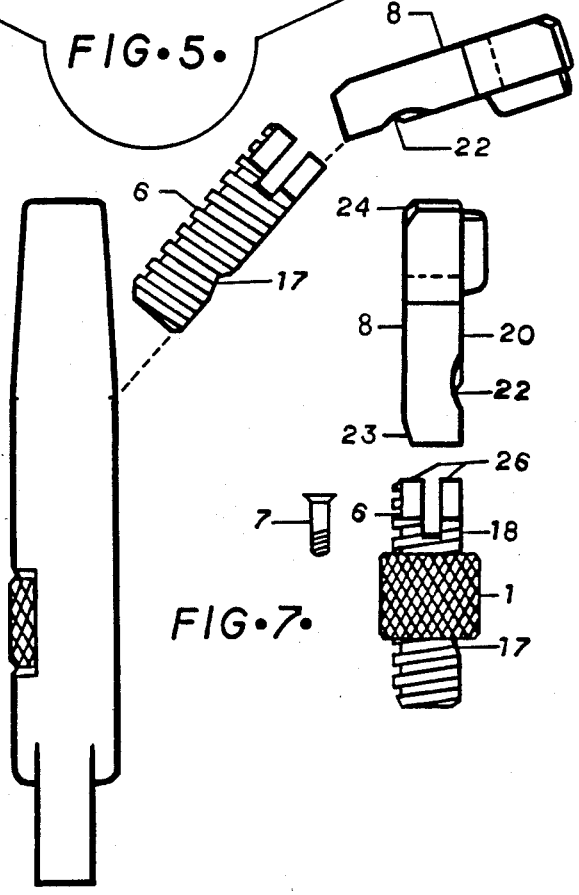
FIG. 7 is an exploded view of the wrench.

A key 8 and an adjustment assembly 6, for adjusting the position of the key 8, are located inside the wrench as shown particularly in FIGS. 2, 5 and 7. Key 8 has an upper face 3, shown in FIG. 5, and a lower body portion 20. Body portion 20 includes a pair of spaced limbs 21, shown in FIG. 4, and an opening 25.

As shown particularly in FIG. 5 the wrench includes a front plate made up of parts 2 and 4 and a bottom plate 5, each formed with openings 19 that are alignable with opening 25 in body portion 20. Plates 2, 4 and 5 are attached to the wrench by, for example, welding when the wrench is made.

The adjustment asssembly 6 for the key 8 comprises a threaded stem 18 having a flattened portion on its rear, as shown in FIG. 4, and including spaced apart limbs 26 formed with aligned openings 28, one of which is threaded.

The limbs 26 fit between the limbs 21 of the body portion 20 so that openings 28 align with opening 25. Screw 7 is threaded into the aligned limbs 26 and 28 to hold the components in the position shown in FIG. 5.

This arrangement, in which the spaced limbs 26 are located between the limbs 21 of the body portion 20, ensures a firm fitting between the key 8 and the stem 18.

An internally threaded adjustment nut 1 is located on the threaded stem 18 so that, when the wrench is assembled, as shown in FIG. 1, rotation of the nut 1 moves key 8 relative to the cavity 11 to provide the necessary adjustment.

The wrench head 10 has an elongated opening, as shown in FIG. 5, having a recess 16 to receive stem 18. The shape of the stem 18 and of recess 16 prevents the stem 18 from rotating with nut 1 and, instead, allows the stem 18 and the attached key 20 to move axially of the wrench head 10.

There is an access opening 19 in the top plate 2 and the bottom plate 5. By appropriate adjustment stem 18 can be moved to a position where screw 7 aligns with the openings 19 to allow the screw 7 to be removed from the wrench head, thus releasing the key 8 from the threaded stem 18. Key 8 can now be removed through the wrench head cavity 11. Then threaded stem 18 is removable by rotating adjustment nut 1 to move the stem 18 along the elongated opening and into wrench head cavity 11.

The particular construction of the key 8 enables its removal as described above. This construction includes chamfered or bevelled corners 24 at the front of the upper face 3 of key 8—see FIG. 7. On the same side of the key 8 the lower ends of the legs 21 are bevelled, as indicated at 23. Intermediate the side of the key 8 opposite from bevel regions 23 and 24 is notch 22 in the body of the key 8. This notch 22 engages on the lower cavity edge 15 on bottom plate 5, to the rear of the wrench head, while edge regions 23 and 24 allow the key to be cleared past the cavity 11 as the key 8 is being pulled directly through the cavity 11 and also as it is being replaced within the cavity 11. Groove 29 is provided in plates 2 and 4 to receive stem 18 and nut 1.

As will be appreciated the assembly is extremely strong as the key 8, when assembled with the adjustment system, 6 is stabilized by the wrench head 10. In prior art arrangements of which applicant is aware, where the key is stabilized by the wrench head, the key is not additionally removable through the cavity. In contrast in the present invention the position of the notch 22 on one side of the body of the key 8 with the chamfered or bevelled edge regions 23 and 24 on the opposite side of the key 8 allows it to be moved out of the cavity. As described above the threaded adjustment assembly can be completely removed from the base of the wrench head, enabling either or both the components to be completely replaced in the event of damage to the assembly.

Various embodiments of the present invention have been described but it would be appreciated by those skilled in the art that variations may be made without departing the spirit of the invention, as defined in the appended claims.

I claim:

1. An adjustable wrench comprising:

a handle having an attached wrench head, said wrench head having a gripping cavity adapted for gripping an object and further having an enlarged opening, said handle defining an axial passage that opens into said gripping cavity adjacent the enlarged opening;

a key comprising an elongated body slidable within said axial passage and having a gripping end extending into said gripping cavity and an attachment end opposite said gripping end, said key body having bevelled surfaces on a first surface adjacent said gripping and attachment ends and a transverse notch formed across a second surface directly opposite said first surface;

key adjustment means for moving said key axially through the passage and comprising a threaded stem fixed against rotation within said axial passage and adapted to engage the key body attachment end, said key adjustment means further comprising removable securing means for removably securing said threaded stem to said key body attachment end, and an adjustment member rotatable about said threaded stem to move said stem axially through said passage in order to engage said key body attachment end and vary the position of said key in said gripping cavity thereby varying the size of said gripping cavity;

access ports in said wrench head providing access to said axial passage so that said securing means can be removed to separate said key and said threaded stem;

said key being removable from said axial passage by sliding said key into said gripping cavity after removal of said securing means such that said key extends into the gripping cavity a distance sufficient to position said notch of said key body against the edge of said enlarged opening of said gripping cavity, and pivoting said key about said edge out of the plane of the gripping cavity for removal from said axial passage through the gripping cavity, the bevelled surfaces of said key providing sufficient clearance with the surfaces of said axial passage and said gripping cavity to allow the key to be pivoted in such a manner;

said threaded stem being removable from said axial pasage by rotating said adjustment member to move said threaded stem out of said axial passage and into said gripping cavity for removal.

2. An adjustable wrench as claimed in claim 3 in which said wrench head comprises an enlarged end portion formed integrally with said handle and having an axially extending elongated cavity therethrough, said wrench head further comprising aligned upper and lower plates sandwiching said enlarged end portion to define said axial passage that houses said key and said key adjustment means, said upper and lower plates having a first set of aligned apertures formed therethrough to define openings into said gripping cavity, one of said apertures being enlarged relative to the other to define said enlarged opening, a second set of aligned apertures to define said access ports and a third set of aligned apertures to provide access for rotation of said adjustment means.

* * * * *